US005106124A

United States Patent [19]

Volkman et al.

[11] Patent Number: 5,106,124

[45] Date of Patent: Apr. 21, 1992

[54] CONVERTIBLE COUPON OR LABEL

[75] Inventors: James B. Volkman, Appleton; David A. Wollangk; Kay F. Grosskopf, both of Neenah, all of Wis.; Eugene E. Dul, Milford, Conn.

[73] Assignee: Menasha Corporation, Neenah, Wis.

[21] Appl. No.: 516,491

[22] Filed: Apr. 30, 1990

[51] Int. Cl.[5] ..... B42D 15/00

[52] U.S. Cl. ..... 283/81; 283/103; 428/41

[58] Field of Search ..... 283/81, 98, 100, 101, 283/103; 428/40, 41

[56] References Cited

U.S. PATENT DOCUMENTS 894,664 7/1908 Kimber ..... 283/71
3,914,483 10/1975 Stipek, Jr. ..... 428/42
4,336,664 6/1982 Penick et al. ..... 40/594
4,700,976 10/1987 Loose ..... 283/81 X
4,854,610 8/1989 Kwiatek ..... 283/81 X

*Primary Examiner*—Timothy V. Eley
*Assistant Examiner*—Willmon Fridie, Jr.
*Attorney, Agent, or Firm*—Quarles & Brady

[57] ABSTRACT

A convertible coupon is usable as a single primary coupon or as a plurality of secondary coupons that are attachable to selected items. The secondary coupons are separable portions of the primary coupon so use of any of them visibly destroys the integrity of the primary coupon to prevent fraud. Several preferred embodiments show various applications and ways of attaching the primary and secondary coupons to one another and to products.

20 Claims, 4 Drawing Sheets

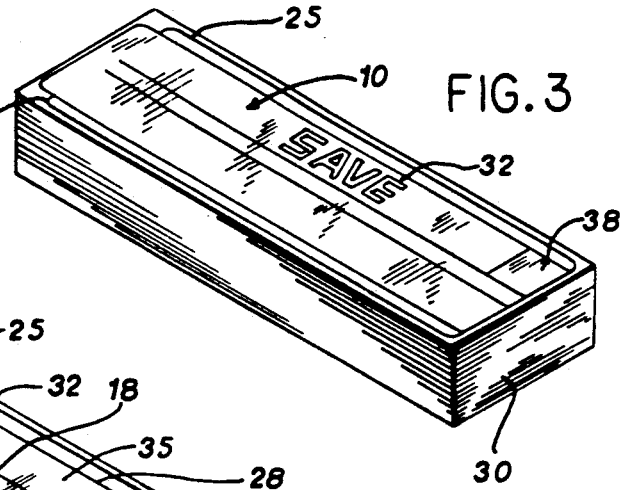
FIG. 3
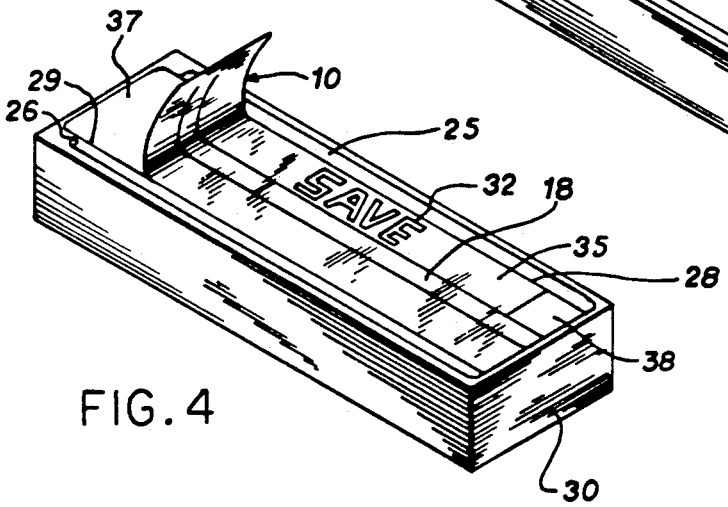
FIG. 4
FIG. 2
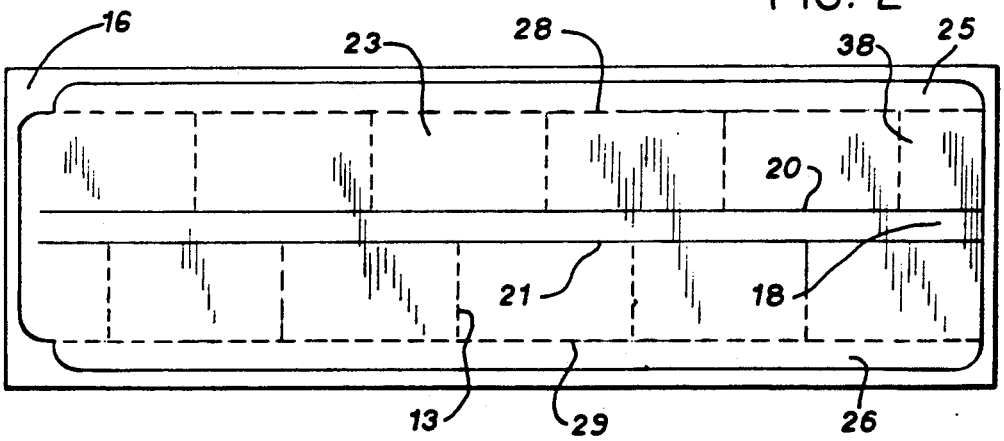
FIG. 1
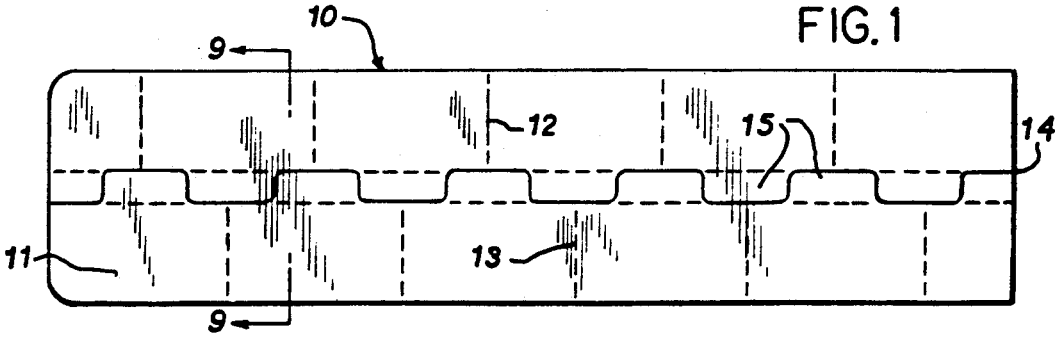

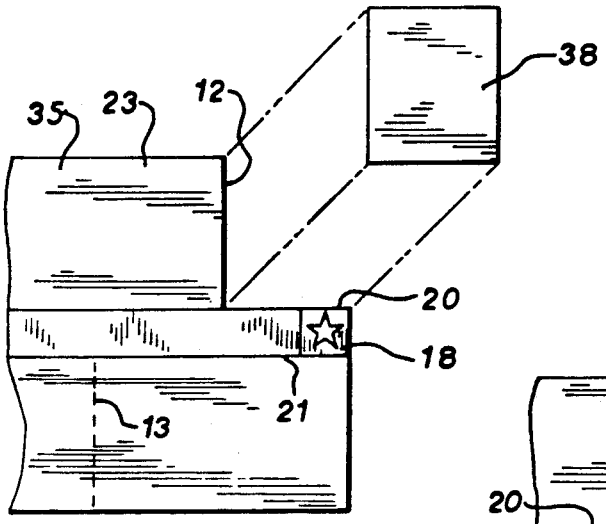
FIG. 5
FIG. 6
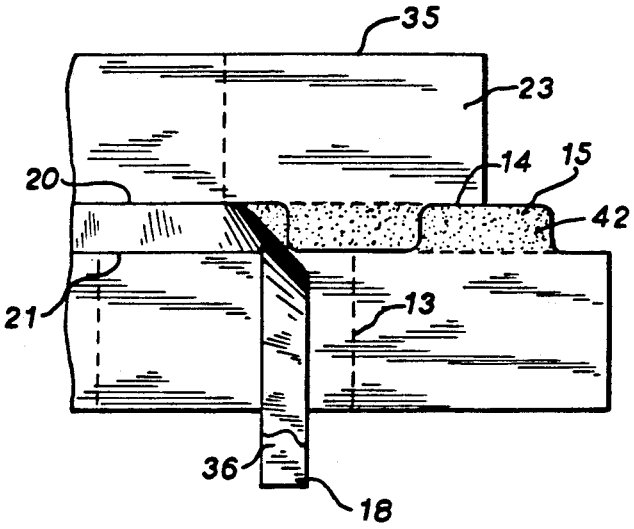
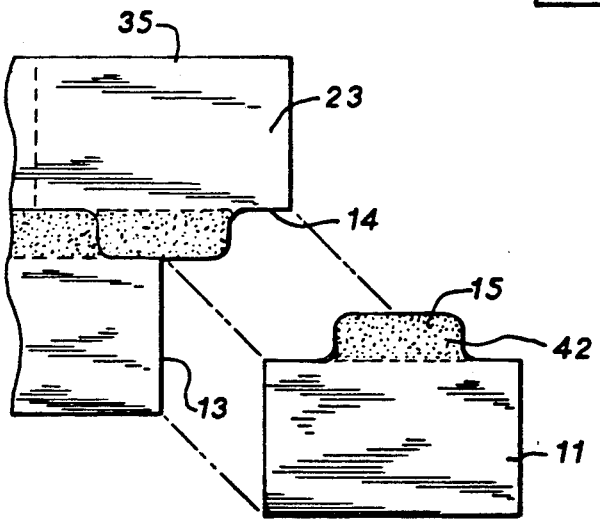
FIG. 7
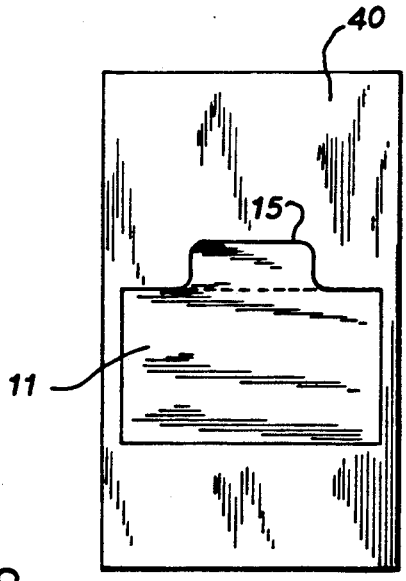
FIG. 8

CONVERTIBLE COUPON OR LABEL

BACKGROUND OF THE INVENTION

This invention relates to a convertible coupon or a label which is dividable and adaptable to different packaging systems. More particularly, it relates to a coupon or a label which in one instance provides a composite of interconnected coupons or labels for application to a container as a single composite label, and in another allows the coupons or labels to be individually separated and applied to a number of smaller containers while rendering the single coupon or label unusable.

There are instances in which a manufacturer may wish to provide a retailer with the option of applying a major cents off type coupon to a multipak of products or using individual cents off type coupons with respect to individual products such as in conjunction with the sale of cigarettes. It is an object of the present invention to enable a manufacturer to provide such an option to a retailer while at the same time preventing the retailer from redeeming both the major coupon and the individual coupons.

A multipart label wherein a main portion can be adhered to a package or a container and inner removable coupons or labels are removable for separately applying to a container is known. This is shown in U. S. Pat. No. 3,914,483 wherein a dual die-cut label is disclosed. In U.S. Pat. No. 4,336,664 there is described a label with puzzle pieces having a pressure sensitive adhesive for relocation and with an outline so as to complete a picture or message.

The prior art does not provide a multipart coupon or a label wherein a multiplicity of such items can be interconnected to provide a unitary coupon or a label which can be applied to a multipak container or alternatively the items can be separated from each other and individually applied to a number of separate containers.

It is an advantage of the present invention to provide an improved multipart coupon or label.

It is another advantage of the present invention to provide a multipart coupon or label which functions alternatively as a large coupon or label in one instance and individual smaller coupons or labels in another while reducing excessive waste material.

It is yet another advantage of the present invention to provide a multipart coupon or label of the foregoing type wherein the individual coupons or labels can be partially exposed in a quick manner by a pull strip.

It is still another advantage of the present invention to provide a multipart coupon or label of the foregoing type wherein the individual coupons or labels are connected to a common backing by attaching or anchoring strips.

It is another advantage of the present invention to provide a coupon or label wherein the removal of an individual coupon or label will disturb the multipart or full structure, and in the case of a coupon, the multipart face layer is rendered useless by destruction.

It is yet another advantage of the present invention to provide a coupon or label of the foregoing type wherein an upper coupon or label can be secured directly to a liner by means of adhesive strips and without a backing material.

SUMMARY OF THE INVENTION

The foregoing advantages are accomplished and the shortcomings of the prior art are overcome by the present composite coupon which includes a main coupon, and a plurality of secondary coupons with removable portions of the main coupon and being attachable to selected items.

In one embodiment, the multipart coupon or label includes at least two or more releasably connected coupons or labels having a first adhesive portion on one side for attaching to a first container and a second adhesive portion on an opposite side for attaching to a second container. In one aspect, the coupons or labels are attached to a backing sheet and the coupons or labels applied to a container as a single coupon or label.

In a preferred embodiment, there are a multiplicity of the coupons or labels which are oppositely positioned and there is a pull strip releasably secured to a portion of the coupons or labels, and the coupons or labels have tab portions which are adhesively secured to the pull strip.

In another preferred embodiment two or more coupons or labels are secured to the backing sheet by two attaching strips which are partially severed from the coupons or labels.

In one aspect the coupons or labels are formed from two layers of material with an adhesive therebetween.

BRIEF DESCRIPTION OF THE DRAWINGS

A better understanding of the present dividable coupon or label will be accomplished by reference to the drawings wherein:

FIG. 1 is a plan view showing one side of the dividable coupon or label of this invention.

FIG. 2 is a top plan view showing the coupon of FIG. 1 in one embodiment.

FIG. 3 is a top perspective view illustrating the coupon of FIG. 2 applied to a cigarette carton.

FIG. 4 is a view similar to FIG. 3 showing a portion of the coupon being removed.

FIGS. 5, 6 and 7 are partial top plan views illustrating a coupon of this invention in further stages of use.

FIG. 8 is a view in side elevation illustrating one of the individual coupons of this invention attached to a single cigarette package.

FIGS. 9*a*–13 are views in cross section illustrating the various embodiments of the coupon or label of this invention.

DESCRIPTION OF THE PREFERRED EMBODIMENTS

Figure 9:
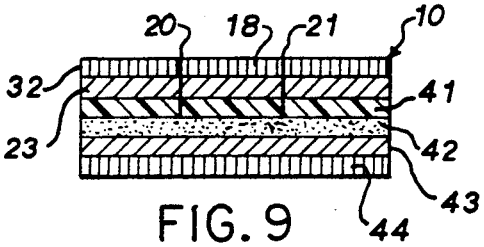
FIG. 9 is a view in cross section taken along line 9—9 of FIG. 1.

Proceeding to a detailed description of the preferred embodiments of the present invention, the two ply dividable coupon generally 10 is illustrated in FIG. 1. Viewed from one side, it is a composite of several individual coupons 11 which are separated along cut or tearing weakness lines 12 and 13. They are also separated along a crenellated cut line 14 to provide tab portions 15. Viewed from the opposite side, the dividable coupon can be employed as a single composite coupon. The use of this coupon will become more apparent as later described.

The dividable coupon 10 may be used by itself as an independent coupon or may be incorporated into a label, as shown in FIG. 2. When incorporated into a pressure sensitive label, the embodiment will have the usual silicone coated backing liner 16 applied thereto which is removed prior to the label being applied to the cigarette cartons 30 of FIGS. 3 and 4. As seen therein, it includes an upper two ply structure 35 with cut lines 28 and 29 to provide for separation of the coupon 10 from the attaching strips 25 and 26 as will best be understood in conjunction with FIGS. 3 and 4.

The dividable coupon 10, incorporated into a label, is illustrated in FIGS. 3 and 4 for use as a single coupon to be redeemable with the purchase of the carton of cigarettes 30. As best seen in FIG. 3, it is secured to the carton 30 after removal of the liner 16. Referring to FIG. 4, it is seen that there is a base ply 37 which is adhesively secured to the carton 30 with a top structure 35 which provides the dividable coupon 10 and upper portions of the attaching strips 25 and 26. The dividable coupon 10 with suitable printing 32 thereon would be removed by tearing along the lines 28 and 29. This would be done when the entire carton 30 of cigarettes would be purchased.

In the instance where the retailer would want to separate out the individual packages of cigarettes and apply individual coupons thereto, the dividable coupon 10 also allows this versatility. In such instance, and referring specifically to FIGS. 5, 6 and 7, the top structure 35 includes the removable panel portion 38 which removal is afforded by the cut lines 20 and 21. The removal of this panel is specifically seen in FIG. 5 and allows easy access to a pull strip 18. Referring specifically to FIG. 6, pulling on this strip 18 and along the cut lines 20 and 21 exposes the tab portions 15 which are defined by the additional crenellated cut line 14. After the removal of the pull strip 18 there results a series of individual coupons 11 as illustrated in FIG. 1. These are defined by the cut lines 12 and 13 as well as 14.

It will be appreciated that the cut lines 20 and 21 which allow the removal of the strip 18 do not extend entirely through the top structure 35 which is composed of the top sheet 23 and the underlying paper face stock 43. This is best seen in conjunction with FIG. 11. The pull strip 18 is in effect cut through the top sheet 23 but not through the underlying paper face stock 43. Cut line 14 extends through the paper stock 43 so that once the pull strip 18 is removed the individual coupons such as illustrated in FIG. 1 are easily detached from each other along the cut line 14. This is illustrated in FIG. 7. As each tab portion 15 of the coupons 11 has an adhesive 42 applied thereto they are easily secured to an individual package of cigarettes 40 such as illustrated in FIG. 8.

Referring back to FIG. 6, it should be pointed out that the end portion 36 of the pull strip 18 has a portion of the paper face stock 43 attached as the cut line 21 is made through the paper face stock in this particular area. This is best appreciated in conjunction with FIGS. 9–13.

FIG. 9 represents a cross sectional view of the dividable coupon 10 as it appears in FIG. 1. There it is seen that it is composed of a multilayer of materials. The top sheet 23 has the printing 32 on one side, and the silicone release material 41 in contact with the pressure sensitive adhesive 42 which in turn is attached to a paper face stock 43 with the printing 44 thereon. FIG. **9*a* is similar to FIG. 9 except that the silicone layer 41 is positioned in a patterned manner only below the pull strip 18 for security purposes which will be later described. The reason for this patterned silicone layer is to allow the pull strip 18 to be separated from the paper face stock 43, yet at the same time, prevent the top sheet 23 and the paper face stock 43 from being separated in other areas by the permanent adhesion of the adhesive 42**.

Figure 10:
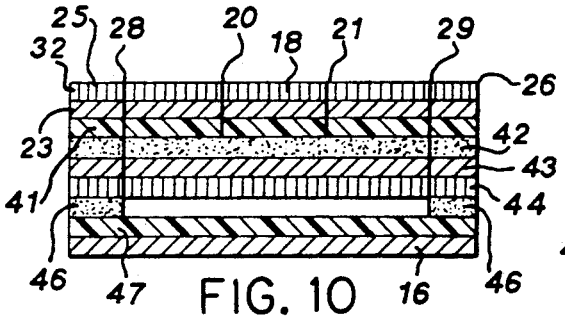

FIG. 10 shows one version of the embodiment shown in FIG. 2. It includes some of the same basic components as described in conjunction with FIG. 9 except it also includes the attaching strips 25 and 26 and the associated tear lines 28 and 29. Also it has adhesive strips 46 for attachment to the carton 30 after removal of the liner 16 by means of the silicone release 47. In this instance, the adhesive strips 46 would be of the pressure sensitive type. FIG. **10*a* illustrates the patterned silicone layer 41 in place of the full layer shown in FIG. 10**.

Figure 9A:
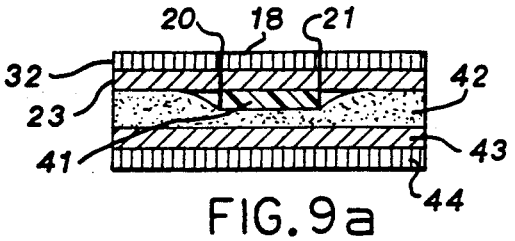
Figure 10A:
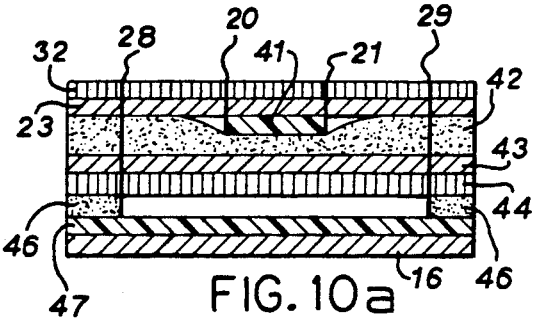
Figure 11:
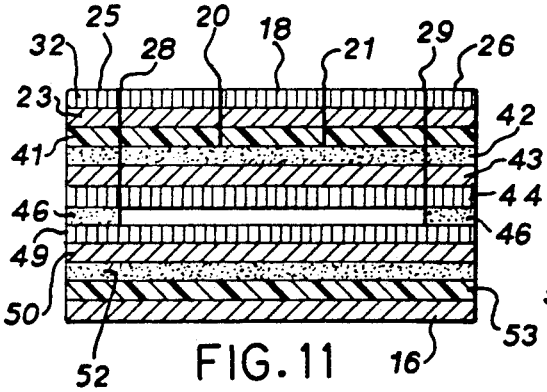

Referring to FIG. 11, this represents another embodiment as shown in FIG. 2. There it is seen that all of the previously described materials 32, 23, 41, 42, 43 and 44 compose the top structure 35. The base ply 37 is composed of the printing matter 49 on the paper face stock 50 which is secured to the paper face stock 43 by the glue strips 46. This secures the top structure 35 to the bottom ply 37 and consequently results in the attaching strips 25 and 26 being formed from these plys. At the opposite side of the paper face stock 50 there is a layer of adhesive 52 and a layer of silicone release material 53 to releasably secure the liner 16. In FIG. **11*a*, there is shown another alternative embodiment which is substantially the same as embodiment 11 except that as was previously explained in conjunction with FIGS. 9*a* and 10*a*, the silicone layer 41 does not extend completely across and between the layer 23 and the adhesive 42**.

Figure 12:
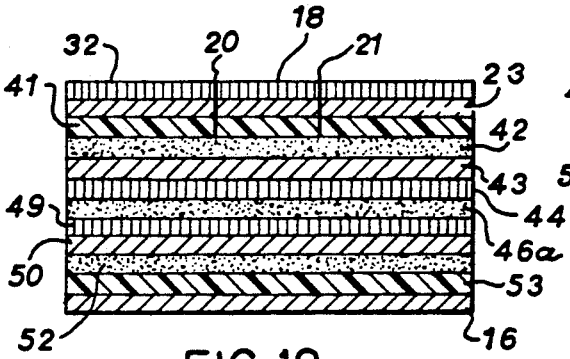

Referring to the embodiment in FIG. 12, this embodiment has basically the same layers of materials as described for the embodiment of FIG. 11. The difference is that there are no attaching strips 25 and 26, and the U. S. Pat. No. 4,479,838. Adhesive **46*a* would be the separation point between the top structure 35 and the bottom ply 37. Note also that it extends completely across the paper stock 50**.

Figure 13:
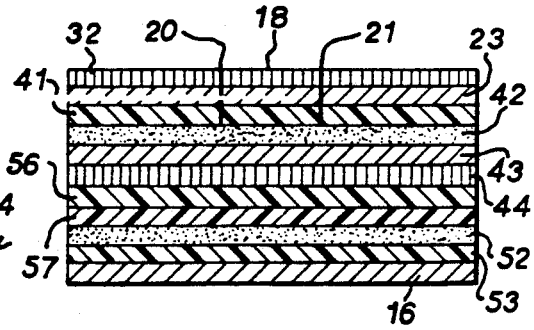

In FIG. 13 there is shown an embodiment similar to that of FIG. 12 except that a base ply which would include the paper layer 50 is not employed. Also the top structure 35 is secured to the liner 16 by the adhesive layer 52 and two separable varnish layers 56 and 57 which materials are known in the art. It will be appreciated that in conjunction with both FIGS. 12 and 13 embodiments, the patterned silicone layer 41 as shown in FIGS. **9*a*, 10*a* and 11*a*** can also be employed.

Figure 14:
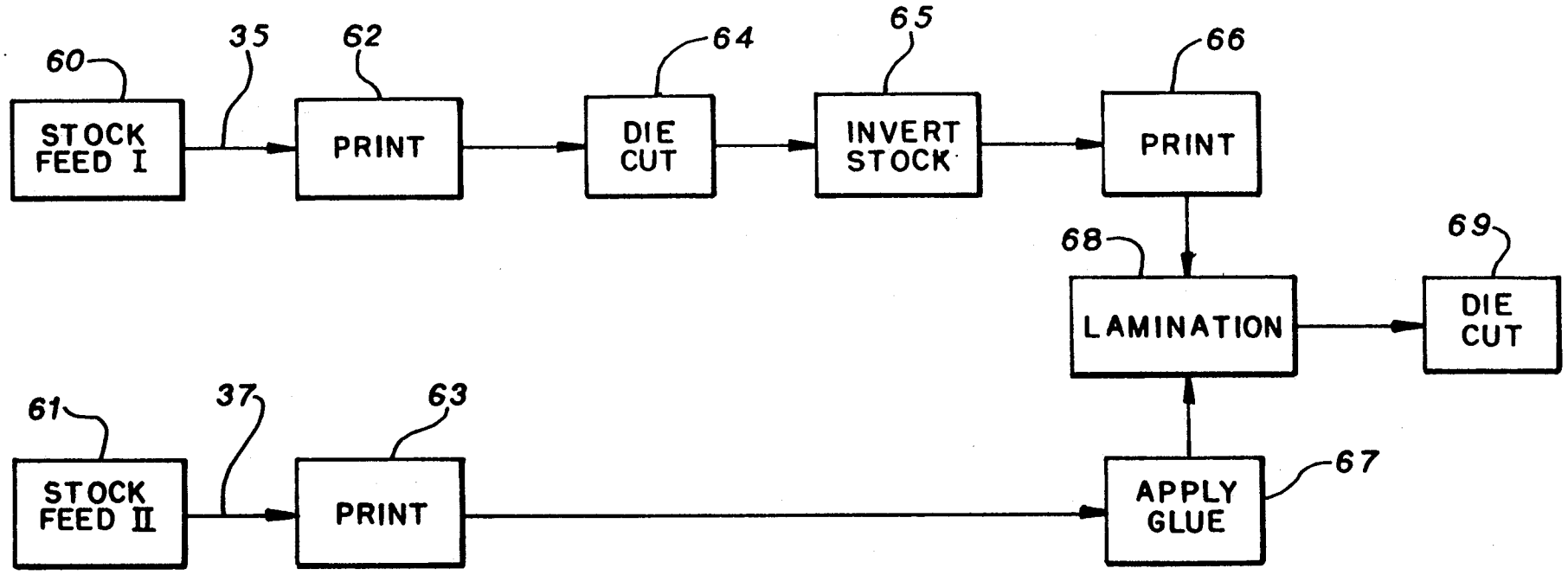
FIG. 14 is a flow diagram illustrating a method for producing a dividable coupon or label of this invention.

Referring to FIG. 14, there is shown a method for manufacturing the dividable coupon 10 of this invention and specifically the embodiment shown in FIGS. 2–4 and 11. The top structure material 35, in this case a pressure sensitive label stock, will be supplied from the dispenser station 60 and the base ply 37 and release liner 16, also composed of a pressure sensitive label stock, from the dispenser station 61. Several printing steps are designated by the station 62 which prints the subject matter such as indicated by the numeral 44 on the backside of the top structure 35. At print station 63 the print material such as 49 is applied on the top of the base ply 37. A die cut station is indicated at 64 for cutting the slits and perforations in the back of the top structure 35 as indicated by the numerals 14 and 12. A turn station is indicated by the numeral 65 which reverses the sides of the top structure 35 for additional printing on the top of the top structure 35 at the station 66. This is represented by the printing 32. As indicated by the numerous printing stations involved, the coupon is of the multi-colored type.

Station 67 is a gluing station wherein the adhesive 46 is applied. The top structure 35 and base ply 37 and 16, respectively, are then laminated at station 68. At station 69 the surface slits or cuts in the top structure 35 are applied as represented by the cut lines 20 and 21, the crenellated cut line 14, as well as the perforations 28 and 29 along the strips 25 and 26. It will be appreciated that in the instance of the embodiments in FIGS. 10 and 13 the base ply 37 and its associated stations such as 61, 63, 67 and 68 would not be employed.

Figure 11A:
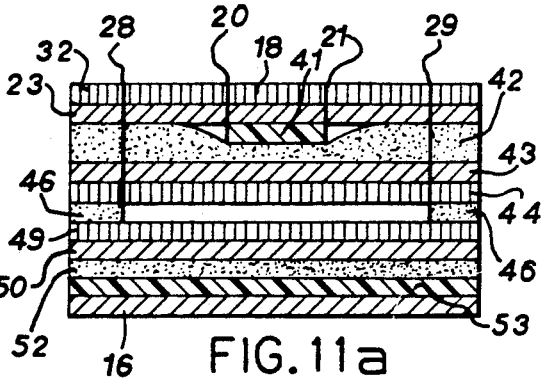

As will be seen from a description of the coupons of this invention, they offer a security advantage and prevent fraudulent presentation of unused coupons. The coupons whether used as a single unit as represented in FIG. 4 or as a multiplicity of individual coupons as shown in FIGS. 5–8 prevent redemption of one of the units which is not actually employed in conjunction with sale of the product. For example, if a separate coupon label were to be supplied with the carton of cigarettes as well as individual coupons, and the retailer is left to the choice of utilizing one or the other, he could utilize the carton coupon in conjunction with the carton of cigarettes and then redeem the individual coupons which in fact were not sold. The dividable coupon of this invention prevents this type of fraud because the missing coupon area provides an immediate visual indication of use. In addition, the embodiments shown in FIGS. 9*a*, 10*a* and 11*a* with the partial release material 41 provide a further safeguard to prevent the separation of the top sheet 23 which forms the face of the carton coupon from the paper face stock 43 which forms the face of the individual coupons. Without this safeguard someone could separate these two and attempt to redeem both.

In the previous description, adhesive materials 42 and 52 have been indicated which are of the pressure sensitive type. Preferably, a pressure sensitive adhesive such as a hot melt type has been employed in this instance. However, others such as synthetic resin adhesives could also be utilized. The adhesive material 46 is preferably of the synthetic resin type, however, others such as a hot melt type could also be utilized. The top sheet 23 and liner material 16 are fabricated preferably from a paper material. If desired, film or film/paper could be utilized in its place. While paper face stocks have been indicated by the numerals 43 and 50, other materials could be substituted such as films or film/paper composites.

It will thus be seen that through the present invention there is now provided a dividable label material which helps to reduce fraud in the utilization of coupons. The dividable coupon label is readily manufactured from available materials while utilizing available apparatus. As is seen in the various embodiments described herein there is provided a versatile coupon adaptable to various configurations yet utilizing the basic principle of a unitary coupon which can be also divided into several smaller coupons. The dividable coupon herein has been described in conjunction with the use of a carton or individual packets of cigarettes. It is obvious that it can be utilized in conjunction with any type of container system wherein smaller items are packaged inside a larger container such as the distribution of soda pop, beer or any consumer item which is sold in dividable lot forms.

While only certain preferred embodiments of the invention have been shown by way of illustration, many modifications and changes will occur to those skilled in the art. It is, therefore, to be understood that the appended claims are intended to cover all of its modifications and changes that fall within the true spirit of the invention.

We claim:

1. A composite coupon comprising a main coupon, and a plurality of secondary coupons, said main coupon having cut or tearing weakness lines extending over substantially all of said main coupon to provide removable portions from the main coupon along said tearing or weakness lines to form said secondary coupons and being attachable to selected items whereby the main coupon is destroyed after the secondary coupons are severed therefrom and wherein there is adhesive means for attaching the secondary coupons to selected items which is exposed by detaching a pull strip from the main coupon.

2. The composite coupon as defined in claim 1 wherein the composite coupon is adhesively but releasably secured to a liner material.

3. The composite coupon as defined in claim 2 wherein the main coupon and the secondary coupons are composed of two layers of sheet material with an adhesive and a release layer therebetween.

4. The composite coupon as defined in claim 3 wherein the release layer is in the form of a patterned strip which is coextensive with the pull strip so as to provide a permanent adhesion between the two layers of sheet material except in an area of the pull strip.

5. The composite coupon as defined in claim 2 wherein the coupon is removed from the liner material and secured to a product.

6. The composite coupon as defined in claim 1 wherein the composite coupon is adhesively secured to a backing material and is removable therefrom.

7. The composite coupon as defined in claim 6 wherein the main coupon is adhesively secured to the backing material by a dry residue adhesive.

8. The composite coupon as defined in claim 6 wherein the main coupon is adhesively secured to the backing material by two separable varnish layers.

9. A multipart dividable coupon or label which can be employed as a single coupon or label or as separate individual coupons or labels comprising:

a backing sheet having an adhesive on one side for attaching to a surface;

the single coupon having cut or tearing weakness lines extending over substantially all of the single coupon to provide at least two or more coupons or labels having a first adhesive portion on one side for attaching to said backing sheet on a side opposite the one side of the backing sheet, said coupons or labels having a second adhesive portion opposite the first adhesive portion for attaching to an other surface;

so that said backing sheet with the two or more coupons or labels can be applied to a surface as a single coupon or label or alternatively two or more coupons or labels can be separated from the backing sheet to destroy the single coupon and applied to a surface.

10. The multipart coupon or label as defined in claim 9 wherein there is a pull strip releasably secured to a portion of the two or more coupons or labels to allow the adhesive on the two or more coupons to be exposed so they can be attached to the surface of a product.

11. The multipart coupon or label as defined in claim 10 wherein there are a multiplicity of the coupons or labels which are oppositely positioned, the coupons or labels having tab portions which are releasably secured to the pull strip.

12. The multipart coupon or label as defined in claim 11 wherein the tab portions are adhesively secured to the pull strip by a pressure sensitive adhesive.

13. The multipart coupon or label as defined in claim 10 wherein the pull strip is partially severed from the coupons or labels.

14. The multipart coupon or label as defined in claim 9 wherein the two or more coupons or labels are secured to the backing sheet by two attaching strips.

15. The multipart coupon or label as defined in claim 14 wherein the attaching strips are attached to said coupons or labels by lines of tearing weakness.

16. The multipart coupon or label as defined in claim 9 wherein said coupons or labels are formed from two layers of sheet material with an adhesive and a release layer therebetween.

17. The multipart coupon or label as defined in claim 16 wherein the layers of material are paper.

18. A multipart coupon or label which can be employed as a single coupon or label or as individual coupons or labels separated therefrom comprising:

the single coupon having cut or tearing weakness lines extending over substantially all of the single coupon to provide at least two or more releasably connected coupons or labels having a first adhesive portion on one side for attaching to a first container and a second adhesive positioned on an opposite side for attaching to a second container;

so that said two or more labels can be applied to said first container as a single label or alternatively said two or more labels can be separated from each other to destroy the single coupon and applied to a said second container.

19. The multipart dividable coupon or label as defined in claim 18 wherein there is a pull strip releasably secured to a portion of the two or more coupons or labels.

20. The multipart dividable coupon or label as defined in claim 19 wherein there are a multiplicity of the coupons or labels which are oppositely positioned, the coupons or labels having tab portions which are releasably secured to the pull strip.

* * * * *

UNITED STATES PATENT AND TRADEMARK OFFICE

CERTIFICATE OF CORRECTION

PATENT NO. : 5,106,124

DATED : April 21, 1992

INVENTOR(S) : James B. Volkman, David A. Wollangk, Kay F. Grosskopf and Eugene E. Dul

It is certified that error appears in the above-identified patent and that said Letters Patent is hereby corrected as shown below:

Column 4, Line 34 before "U.S. Pat." --adhesive 46a is of the dry residue type as described in-- should be inserted.

Signed and Sealed this

Twentieth Day of July, 1993

*Attest:*

Michael K. Kirk

MICHAEL K. KIRK

*Attesting Officer*

*Acting Commissioner of Patents and Trademarks*